US007335075B2

(12) United States Patent
Nakamura et al.

(10) Patent No.: US 7,335,075 B2
(45) Date of Patent: Feb. 26, 2008

(54) OUTBOARD MOTOR WITH COWLING

(75) Inventors: Daisuke Nakamura, Shizuoka-ken (JP); Yoshihito Fukuoka, Shizuoka-ken (JP); Isao Fujii, Shizuoka-ken (JP); Hirotoshi Yamauchi, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/320,372

(22) Filed: Dec. 28, 2005

(65) Prior Publication Data

US 2006/0141878 A1 Jun. 29, 2006

(30) Foreign Application Priority Data

Dec. 28, 2004 (JP) ..... 2004-378528
Dec. 28, 2004 (JP) ..... 2004-378533

(51) Int. Cl.
*B63H 20/32* (2006.01)

(52) U.S. Cl. ..... 440/77

(58) Field of Classification Search ..... 123/195 P; 440/88 A, 76, 77, 78; 181/229
See application file for complete search history.

(56) References Cited

U.S. PATENT DOCUMENTS 4,583,953 A * 4/1986 Nakase ..... 440/52
4,723,927 A * 2/1988 Walsh et al. ..... 440/77
5,536,187 A * 7/1996 Nanami ..... 440/38
5,756,945 A * 5/1998 Maeda et al. ..... 181/272
5,873,755 A * 2/1999 Takahashi et al. ..... 440/77
6,099,371 A * 8/2000 Nozawa et al. ..... 440/77
6,488,552 B2 12/2002 Kitsu et al.
6,719,597 B2 4/2004 Yoshioka et al.
7,118,432 B2 * 10/2006 Katayama ..... 440/77

FOREIGN PATENT DOCUMENTS

JP 2004-299485 10/2004

* cited by examiner

*Primary Examiner*—Ed Swinehart
(74) *Attorney, Agent, or Firm*—Knobbe, Martens, Olson & Bear, LLP

(57) ABSTRACT

An outboard motor includes an engine. A cowling body defines an internal cavity in which the engine is enclosed. A partition member divides the internal cavity into a first cavity and a second cavity. The first cavity communicates with outside through a first opening for introducing ambient air into the first cavity. The second cavity encloses the engine therein. The partition member has a second opening through which the air in the first cavity moves to the second cavity. The cowling body and the partition member are made of a nonferrous metal. The partition member is adhered to the cowling body.

24 Claims, 9 Drawing Sheets

OUTBOARD MOTOR WITH COWLING

PRIORITY INFORMATION

This application is based on and claims priority to Japanese Patent Applications No. 2004-378528, filed on Dec. 28, 2004, and No. 2004-378533, filed on Dec. 28, 2004, the entire contents of which are hereby expressly incorporated by reference.

BACKGROUND OF THE INVENTION

1. Field of the Invention

The present invention relates generally to an outboard motor, and more particularly relates to an outboard motor having a cowling which encloses an engine.

2. Description of Related Art

Typically, outboard motors are mounted on a transom board of an associated watercraft. Such an outboard motor usually has an engine for powering a propulsion device such as, for example, a propeller that generates thrust force of the watercraft. A cowling typically defines an engine compartment that surrounds the engine for protecting the engine.

The cowling typically includes a structure for allowing outside air to enter the engine compartment to provide intake air for the engine. The cowling preferably is configured to block most or all splashing water from entering the engine compartment through the air intake structure, but allows air to enter. In one prior structure, the air intake structure includes an air duct that extends upward from a top surface of the cowling. A cover member extends over the air duct member so as to form a space between the cowling and the cover. Ambient air can enter the space from which the air duct conducts such air into the engine compartment. However, since the air duct extends upwardly from the cowling surface, water that may enter the space is blocked from flowing through the air duct. See, for example, Japanese Patent No. 3046391.

Outboard motors typically include an internal combustion engine that generates significant heat during operation. As can be appreciated, this heat can warm up the air within the engine compartment. Further, traditionally, outboard motor cowlings are made of a synthetic resin that is not very heat conductive. As such, heat from the engine is generally not transferred to the cowling, and instead is radiated to the air. Hot engine intake air can result in a decline of engine charging efficiency.

In order to expedite the radiation of the heat through the cowling, Japanese Patent Publication No. P2004-299485A discloses a cowling made of nonferrous metal. Some cowlings disclosed in this publication have an air duct member and top cover portion of the body of the cowling. Although the radiation of heat can be greatly improved, the cowling can be heavier than a conventional resin-based cowling.

SUMMARY OF THE INVENTION

A need thus exists for an outboard motor that can be furnished with a light cowling that also dissipates heat.

In accordance with one embodiment, an outboard motor is provided comprising an engine, a cowling body defining an internal cavity in which the engine is enclosed, and a partition member dividing the internal cavity into a first cavity and a second cavity. A first opening is formed through the cowling body and opens into the first cavity for introduction of outside air into the first cavity. The second cavity encloses the engine therein. The partition member has a second opening through which air in the first cavity is introduced into the second cavity. The cowling body and the partition member are made of a nonferrous metal, and the partition member is adhered to an inner surface of the cowling body with an adhesive.

In accordance with another embodiment, a circumferential portion of the partition member is bent generally downward so as to be complementary to an inner surface of the cowling body, and the circumferential portion is adhered to the inner surface of the cowling body. In yet another embodiment, the circumferential portion of the partition member fits generally flush against the inner surface of the cowling body so as to create a seal about the circumferential portion between the partition member and the cowling body. In one embodiment, the partition member and the cowling body are made of substantially the same material. In a still further embodiment, no mechanical fasteners are used to connect the partition member to the cowling body. In a still further embodiment, the partition member has at least one aperture for discharging water from the first cavity. In yet a further embodiment, an inner pad is affixed to an inner surface of an upper edge portion of the cowling body above the first opening.

In accordance with yet another embodiment, a method of making an outboard motor is provided. The method comprises providing an engine, providing a cowling comprising a top cowling body having an inner surface and an intake air opening formed through the cowling body, and providing a partition member having an air duct opening formed therethrough. The partition member has a circumferential flange that is generally complementary to a portion of the inner surface of the top cowling body. The method further contemplates applying an adhesive to the circumferential flange and adhering the circumferential flange to the inner surface of the top cowling body so that the flange fits substantially flush with the top cowling body and an intake space is defined between the partition member and the inner surface of the top cowling body. The partition member is positioned so that the intake air opening opens into the intake space.

BRIEF DESCRIPTION OF THE DRAWINGS

These and other features, aspects and advantages of the present invention are now described with reference to the drawings of preferred embodiments, which are intended to illustrate and not to limit the present invention. The drawings include nine figures in which.

DETAILED DESCRIPTION OF PREFERRED EMBODIMENTS

Figure 1:
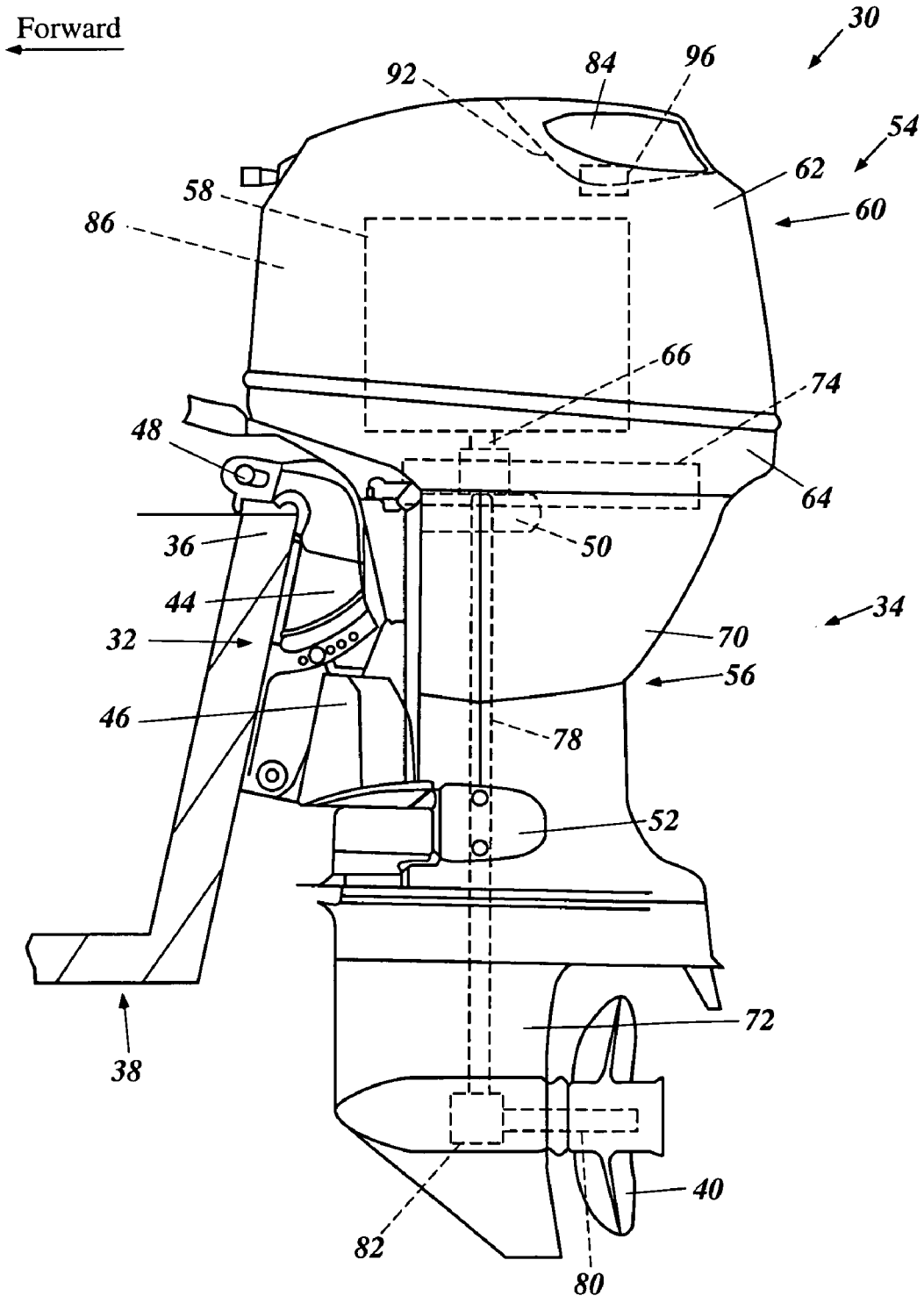
FIG. 1 is a side elevational view of an outboard motor configured in accordance with certain features, aspects and advantages of a preferred embodiment of the present invention, a transom of an associated watercraft shown in part.

With reference to FIG. 1, an overall structure of an outboard motor 30 preferably includes a mount unit 32 and a drive unit 34. The mount unit 32 supports the drive unit 34 on a transom board 36 of an associated watercraft 38 and places a marine propulsion device such as, for example, a propeller 40 in a submerged position with the watercraft 38 resting relative to a surface of a body of water. The drive unit 34 can be tilted up (raised) or tilted down (lowered) relative to the watercraft 38.

As used through this description, the terms "forward" and "front" mean at or to the side of the outboard motor 30 where the mount unit 32 is located, unless otherwise indicated or otherwise readily apparent from the context used. Also, the terms "rear" and "rearward" mean at or to the opposite side of the front side. The arrow FWD of FIGS. 1-3, 5, 7-9 indicates a forward direction of the outboard motor 30.

Also, as used in this description, the term "horizontally" means that the subject portions, members or components extend generally parallel to the water surface when the watercraft 38 is substantially stationary with respect to the water surface and when the drive unit 34 is not tilted and is generally placed in the position shown in FIG. 1. The term "vertically" means that portions, members or components extend generally normal to those that extend horizontally.

With continued reference to FIG. 1, the mount unit 32 preferably includes a clamping bracket 44, a swivel bracket 46, a tilt pin 48 and a steering shaft. The clamping bracket 44 preferably includes a pair of bracket arms that are transversely spaced apart from each other and can be affixed to the transom board 36. The tilt pin 48 extends generally horizontally and completes a hinge coupling between the swivel bracket 46 and the clamping bracket 44. The tilt pin 48 extends through the clamping bracket 44 and the swivel bracket 46 in such a manner that the clamping bracket 44 supports the swivel bracket 46 for pivotal movement about an axis of the tilt pin 48.

The swivel bracket 46 preferably carries the drive unit 34 for pivotal movement about an axis of the steering shaft, which extends generally vertically. The swivel bracket 46 is affixed to the drive unit 34 by upper and lower mount members 50, 52. The swivel bracket 46 and the drive unit 34 thus can be tilted together about the axis of the tilt pin 48 relative to the clamping bracket 44.

The drive unit 34 preferably includes a power head 54 and a housing unit 56. The power head 54 is disposed atop the drive unit 34 and includes an internal combustion engine 58. In order to protect the engine 58, the power head 54 also includes a protective cowling 60 that surrounds the engine 58.

The cowling 60 preferably includes a top cowling member 62 and a bottom cowling member 64. The top cowling member 62 is detachably coupled with the bottom cowling member 64. The engine 58 in this embodiment is a four stroke engine, and generates the power for driving the propeller 40. The engine 58 has a crankshaft 66 preferably extending generally vertically. It is to be understood that engines operating on different combustion principles, such as 2-stroke, diesel, or the like, can also be employed. Additionally, engines of various arrangements, such as in-line cylinder, V-shaped cylinder, and rotary-type engines can be employed.

The housing unit 56 preferably includes an upper casing (or driveshaft housing) 70 and a lower casing 72. The illustrated upper and lower casings 70, 72 preferably are made of an aluminum alloy. The upper casing 70 is disposed below the power head 54 and is coupled with the power head 54. Preferably, a top end of the upper casing 70 is coupled with the bottom cowling member 64 through an exhaust guide 74. The bottom cowling member 64 and the exhaust guide 74 together form a tray that accepts the engine 58. The engine 58 is fixed to the tray.

The upper casing 70 journals a driveshaft 78 that extends generally vertically within the upper casing 70. A top end of the driveshaft 78 is coupled with a bottom end of the crankshaft 66. The lower casing 72 depends from the upper casing 70. The lower casing 72 journals a propulsion shaft 80 that extends generally horizontally within the lower casing 72.

The driveshaft 78 and the propulsion shaft 80 are coupled with each other for rotation through a transmission mechanism 82 which includes a forward-neutral-reverse change device. The propeller 40 is connected to an end of the propulsion shaft 80. Thus, the power generated by the engine 58 is transmitted to the propeller 40 through the driveshaft 78, the transmission 82 and the propulsion shaft 80. The propeller 40 rotates to produce the thrust that propels the associated watercraft 38. It is to be understood that other propulsion mechanisms, such as dual counter-rotating propellers or a jet drive, may also be employed.

The top cowling member 62 has an air intake opening 84 through which outside air enters an internal cavity 86 of the cowling 60. The intake opening 84 is preferably disposed at a rear top portion of the top cowling member 62.

Air is introduced into the engine 58 through an intake system of the engine 58 for combustion of fuel which is delivered also to the engine 58 through a proper fuel supply system. The upper and lower casings 70, 72 also define an exhaust passage of an exhaust system. Exhaust gases discharged from the engine 58 enter part of the exhaust system in the upper casing 70 through the exhaust guide 74. The exhaust gases are discharged generally to an external location under a surface of the water body through the upper and lower casings 70, 72 and the propeller 40.

With reference next to FIGS. 1-4, in a preferred embodiment, the illustrated top and bottom cowling members 62, 64 together define the internal cavity 86. That is, a bottom of the top cowling member 62 opens downward to form a bottom opening 90, while a top of the bottom cowling member 64 opens upward to form a top opening. The top cowling member 62 is detachably coupled with the bottom cowling member 64 by a lock mechanism to close the bottom opening 90 thereof and the top opening of the bottom cowling member 64. The internal cavity 86 thus communicates with the outside only through the intake opening 84. The illustrated top cowling member 62 forms the major part of a body of the cowling 60.

The top and bottom cowling members 62, 64 preferably are made of a nonferrous metal such as, for example, aluminum, magnesium, an aluminum alloy, a magnesium alloy and the like. Such nonferrous metals are generally of lightweight and have good heat transfer properties. The top and bottom cowling members 62, 64 can be produced by die-casting, press or the like. In this embodiment, at least the top cowling member 62 is made of an aluminum alloy.

In order to allow outside air to be introduced into the internal cavity so as to be available to the engine 58, but also to block water from entering the engine compartment, the top cowling member 62 preferably has a partition member 92. The partition member 92 divides the internal cavity 86 into a relatively large cavity 86*a* and a relatively small cavity 86*b*. The large cavity 86*a* defines an engine compartment that encloses the engine 58 therein; the small cavity 86*b* defines an intake air chamber that communicates with the outside of the cowling 60 through the intake opening 84.

Figure 3:
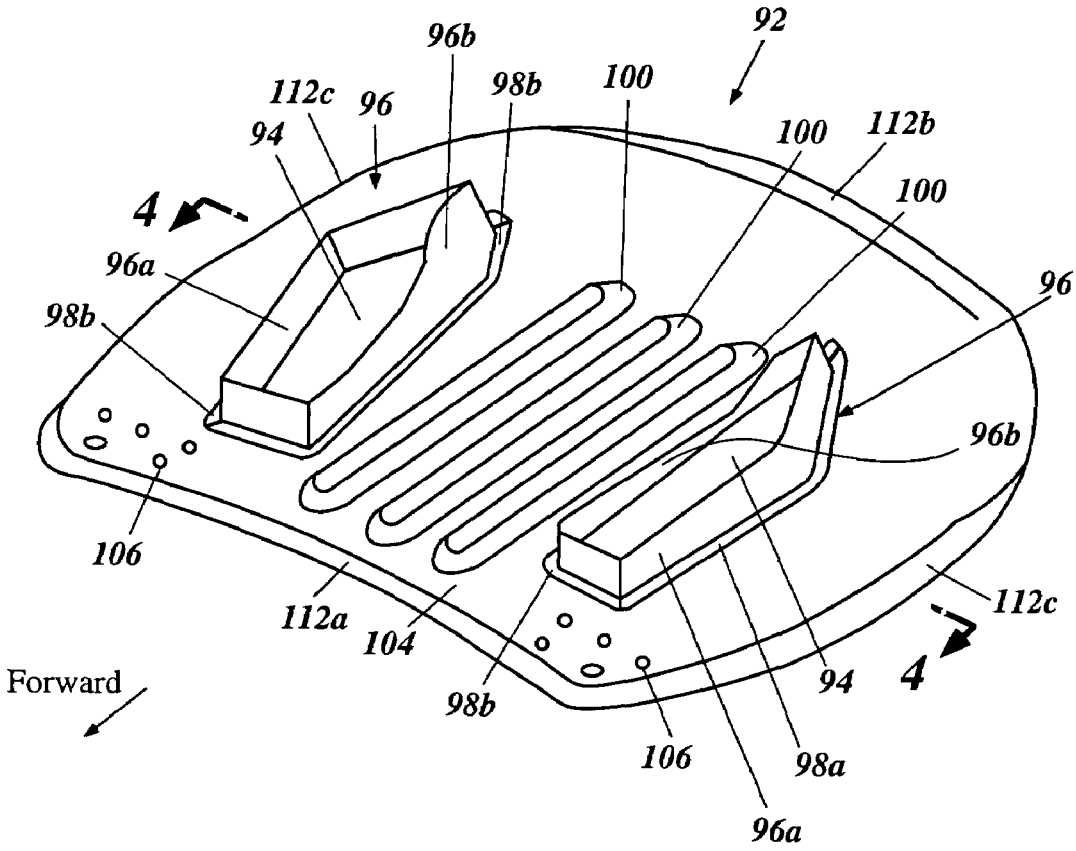
FIG. 3 is a perspective view of the partition member of FIG. 2.
Figure 4:
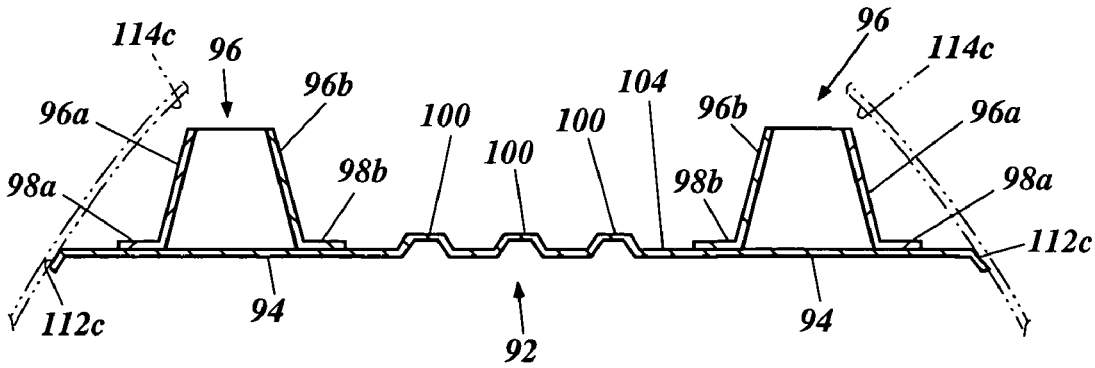
FIG. 4 is a cross sectional view of the partition member taken along the line 4-4 of FIG. 3.

In the embodiment shown in FIGS. 3 and 4, the partition member 92 has a pair of inlet openings 94 spaced apart transversely to be positioned side by side. Each inlet opening 94 is elongate in a fore to aft direction of the outboard motor 30. The large cavity 86*a* and the small cavity 86*b* communicate with each other through the inlet openings 94. Thus, air in the small cavity 86*b* can move to the large cavity 86*a*.

Preferably, a tubular air duct 96 is attached to a circumferential portion of each inlet opening 94 so as to extend therefrom. Each air duct 96 preferably is tapered as it extends upwardly into the small cavity 86*b*.

In the illustrated embodiment, each air duct 96 is formed by two separately-formed pieces 96*a*, 96*b* that are adhered to each other to complete the respective air duct 96. Each separable member 96*a*, 96*b* has a margin or flange 98*a*, 98*b* that is sized and configured to accommodate an adhesive applied thereto. A bottom end of each separable member 96*a*, 96*b* preferably extends outward to form the flange 98*a*, 98*b*. Each flange 98*a*, 98*b* is adhered to the circumferential portion of the respective inlet opening 94 by an adhesive so that the each air duct 96 substantially surrounds the respective inlet opening 94.

In another embodiment, each air duct 96 is formed by a single piece that has a tubular shape. In other embodiments, the respective air ducts 96 are unitarily formed with the partition member 92, as a portion thereof, in such a manner that the circumferential portions of the respective inlet openings 94 are bent to form the tubular shape.

The partition member 92 preferably comprises, or is wholly made of a nonferrous metal such as, for example, aluminum, magnesium, an aluminum alloy, a magnesium alloy and the like. Preferably, the partition member 92 is made of the same metal as the top cowling member 62. The partition member 92 can be produced by die-casting, press or the like. In a preferred embodiment, the partition member 92 is made of the same aluminum alloy as the top cowling member 62 and is produced by press.

Each air duct 96 preferably is also made of a nonferrous metal such as, for example, aluminum, magnesium, an aluminum alloy, a magnesium alloy and the like. Also, each air duct 96 can be produced by die-casting, press or the like. In a preferred embodiment, each air duct 96 is made of the same aluminum alloy as the top cowling 62 and the partition member 92, and is produced by press.

The partition member 92 preferably has a plurality of projections. In the illustrated embodiment, the partition member 92 has three elongate projecting strips, or ribs 100. The strips 100 preferably extend in an area 104 located between the inlet openings 94 (i.e., the air ducts 96) and parallel to each other. The strips 100 preferably extend in the fore to aft direction of the outboard motor 30 when the partition member 92 is affixed to the top cowling member 62. The projected strips 100 are formed by press, and preferably are made simultaneously when the partition member 92 is pressed.

The projected strips 100 preferably reinforce the rigidity of the partition member 92. The partition member 92 thus can be formed as thin as possible. In other words, the partition member 92 can be made thin and light, but with sufficient strength, thus helping to reduce the total weight of the cowling 60.

It should be noted, however, that the projected strips 100 are not necessarily provided to make the partition member 92 lighter. In addition, other shapes such as, for example, a circular or rectangular shapes, multiple ribs in various directions, or the like, can replace the strip.

As shown in FIG. 3, the partition member 92 preferably has a water draining system. In the illustrated embodiment, the partition member 92 has a plurality of water draining holes 106. The draining holes 106 preferably are positioned at right and left corners of the partition member 92 which are placed in the most forward end of the partition member 92 when the partition member 92 is affixed to the top cowling member 62. Preferably, multiple drain holes 106 are provided at each location.

With additional reference to FIG. 2, a water receiver 108 is preferably placed below each of the right and left corners of the partition member 92 to receive water that falls through the drain holes 106. The respective water receivers 108 are preferably unitarily formed with the partition member 92. However, in additional embodiments, the water receivers 108 are separately formed from the partition member 92 and are adhered to the partition member 92. In this embodiment, the receivers 108 can be made of the same or similar nonferrous metal as the cowling 60, or can be made of a synthetic resin.

Each water receiver 108 preferably has a water draining pipe 110. Preferably, the pipe 110 is flexible and has a sufficient length to reach a bottom end of the top cowling member 62.

Circumferential edge portions of the partition member 92 preferably are bent generally downward so as to extend along and complement an inner surface of the top cowling member 62. Because the circumferential portions are bent downward, the partition member 92 can be easily inserted into the top cowling member 62 through the bottom opening 90. In the illustrated embodiment, circumferential portions positioned at front, rear and both lateral sides are bent to form front, rear, and side margins or flanges 112*a*, 112*b*, 112*c*, respectively. Preferably, every flange 112*a*, 112*b*, 112*c* is continuously connected to the next one in the entire circumferential end of the partition member 92.

Figure 2:
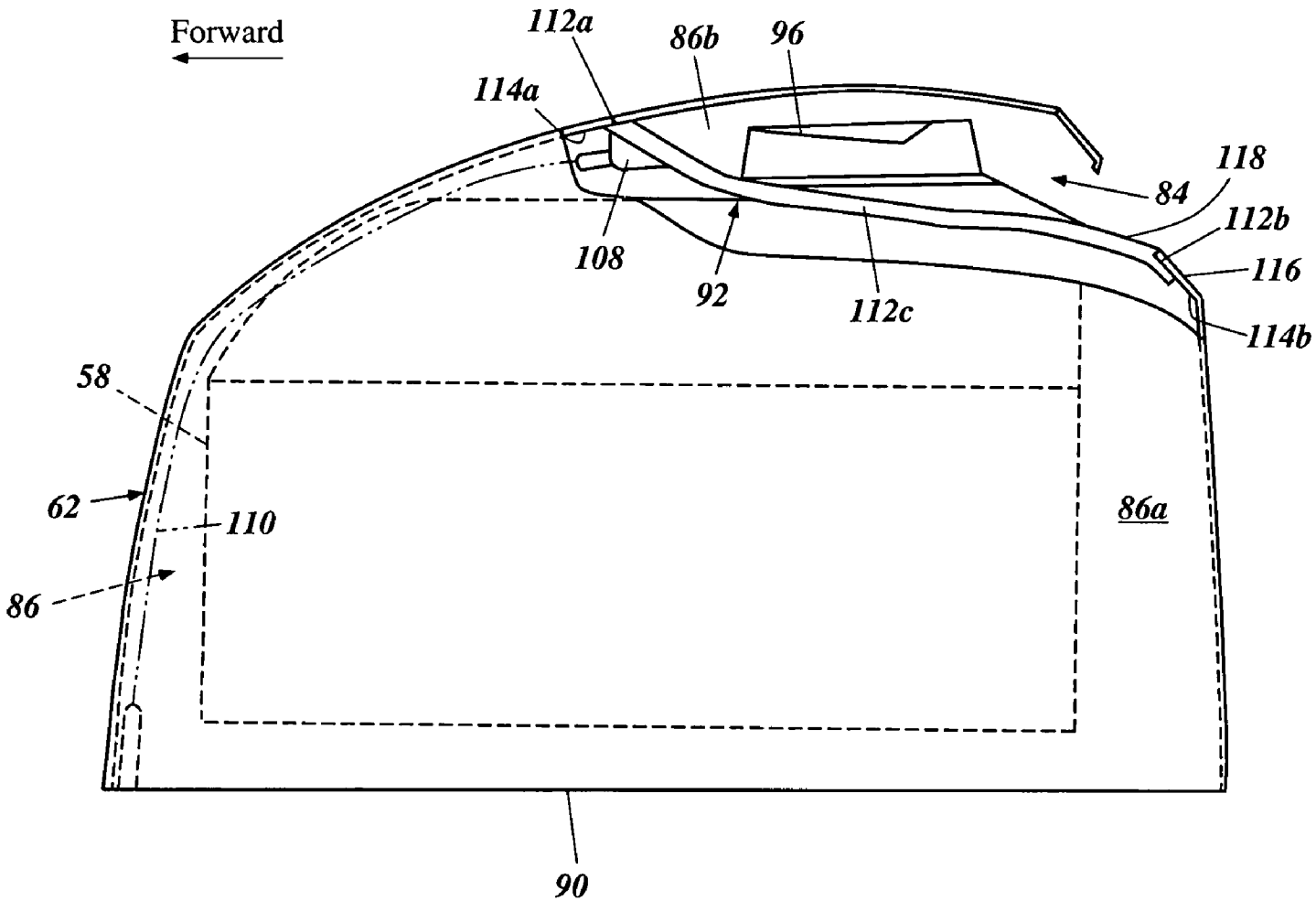
FIG. 2 is a side elevational view of a top cowling member of the outboard motor of FIG. 1, the top cowling member partly sectioned to show a partition member.

As shown in FIG. 2, the front margin 112*a* preferably is adhered to a top inner surface 114*a* of the top cowling member 62 by an adhesive at or generally around a middle portion thereof in the fore to aft direction.

The rear margin 112*b* preferably is adhered to a rear inner surface 114*b* of the top cowling member 62 below the intake opening 84. Preferably, a lower edge portion 116 immediately below the intake opening 84 is slanted generally upwardly, and complementarily fits with the rear flange 112*b* of the partition member 92. Preferably, the partition fits flush against the edge 116. Additionally, and as shown in FIG. 2, preferably the partition member 92 slants generally upwardly in a forward direction.

The side margins 112*c* of the partition member 92 preferably are adhered to side inner surfaces 114*c* of the cowling member 62. The side inner surfaces 114*c* are best illustrated on FIG. 4.

In the embodiment illustrated in FIGS. 1-4, the margins 112*a*, 112*b*, 112*c* are continuously made. As such, the entire circumferential portion of the partition member 92 is adhered to the inner surface of the top cowling member 62. More specifically, there is no gap between the circumferential portion of the partition member 92 and the inner surface of the top cowling member 62. Thus, no supplemental seal member is necessary to prevent water from leaking between the margins 112*a*, 112*b*, 112*c* and the cowling 62. In addition, the partition member 92 adhered to the top cowling member 62 provides reinforcement to the top and side portions of the top cowling member 62.

When the partition member 92 is affixed to the top cowling member 62, the water draining pipe 110 extends along the inner surface of the top cowling member 62. Preferably, a plurality of fasteners affix portions of the pipe 110 to the inner surface of the top cowling member 62. In another embodiment, hooks or another type of fastener are attached to or unitarily formed with the inner surface of the top cowling member 62 so as to hold the pipe 110 in place.

Preferably, the bottom end of the top cowling member 62 or the bottom cowling member 64 comprises a drain aperture, and a terminal end of the water draining pipe 110 is connected to the drain aperture. Thus, the water can be drained through the water draining holes 106, the water receivers 108, the water draining pipe 110 and the drain aperture.

As thus constructed, outside air is introduced into the small cavity 86*b* when the engine 58 operates. The air in the small cavity 86*b* surmounts the outer walls of the respective air ducts 96 and enters the large cavity 86*a* through the air ducts 96. The air is further introduced into the intake system of the engine 58 to be used for combustion. Splashing water can enter the small cavity 86*b* together with the air. The water, however, generally cannot surmount the outer walls of the air ducts 96, and thus remains upon the top surface of the partition member 92. As such, very little or no air flows through the ducts 96.

In the illustrated embodiment, the three projected strips 100 extend parallel to each other in the fore to aft direction of the outboard motor 30. Thus, the airflow is not hampered by the strips 100. That is, air flow resistance does not increase. The strips 100 do not hamper flow of the water either, even though water can enter the small cavity 86*b*. In addition, because the front end of the partition member 92 is adhered to the top inner surface of the top cowling member 62, the partition member 92 makes a slope extending downward rearward. Because of the slope and the direction of the stripes 100, the water that enters the small cavity 86*b* can easily flow backwardly and out of the intake opening 84. Further, even if water ascends the slope, it can be discharged through the draining system described above.

As discussed above, in the illustrated embodiment, the partition member 92 is made of an aluminum alloy. Preferably, the partition member 92 is made as thin as possible while maintaining necessary rigidity. Overall, the cowling 60 can be made very lightweight by incorporating lightweight components such as the partition member 92.

Since the partition member 92 is constructed of a non-ferrous metal, such as an aluminum alloy, it readily communicates heat away from the engine into the cowling 60, from which heat is radiated to the outside. Thus, the heat of air within the engine compartment 86*a* is reduced relative to non-heat-conductive cowlings, such as resin cowlings. As such, the charging effect of the engine is enhanced, and engine output is also enhanced.

As discussed above, preferably the partition member 92 is constructed of the same material as the top cowling member 62. Thus, these members perform especially well when the partition member 92 is adhered to the inner surface of the top cowling member 62 by an adhesive. Making these members of the same material is also advantageous because no preliminary treatment is necessary before the adhering process. The quality of adhesion is particularly good, and due to the ease and simplicity of the process, production costs of the cowling 60 is reduced.

In the illustrated embodiment, no fasteners such as, for example, bolts and nuts, are necessary for coupling the partition member 92 with the top cowling member 62. The cowling 60 thus can be very lightweight and can be produced quickly and at small cost. 100611 With reference next to FIGS. 5-7, another top cowling member 62A modified in accordance with a second embodiment of the present invention is described. The same or similar members, components and the like described above will be assigned with the same reference numerals and will not be discussed repeatedly unless further discussions are considered warranted.

Usually, an edge portion of the top cowling member above the intake opening is used as a handle grip when the drive unit is tilted up. That is, when the drive unit 34 of FIG. 1 is raised, an operator inserts his or her hand into the intake opening 84 and grips an edge portion 130 of the top cowling member 62A above the intake opening 84 and pulls the top cowling member 62A so that the drive unit 34 pivots about the axis of the tilt pin 48. In some embodiments, the top cowling member 62A is generally thin. A thin edge portion 130 can be uncomfortable for an operator to grasp.

In addition, because the circumferential portion 130 often is unsupported, it may be susceptible to vibration in resonance with the operation of the engine 58. The vibration noise can bother the operator.

Figure 5:
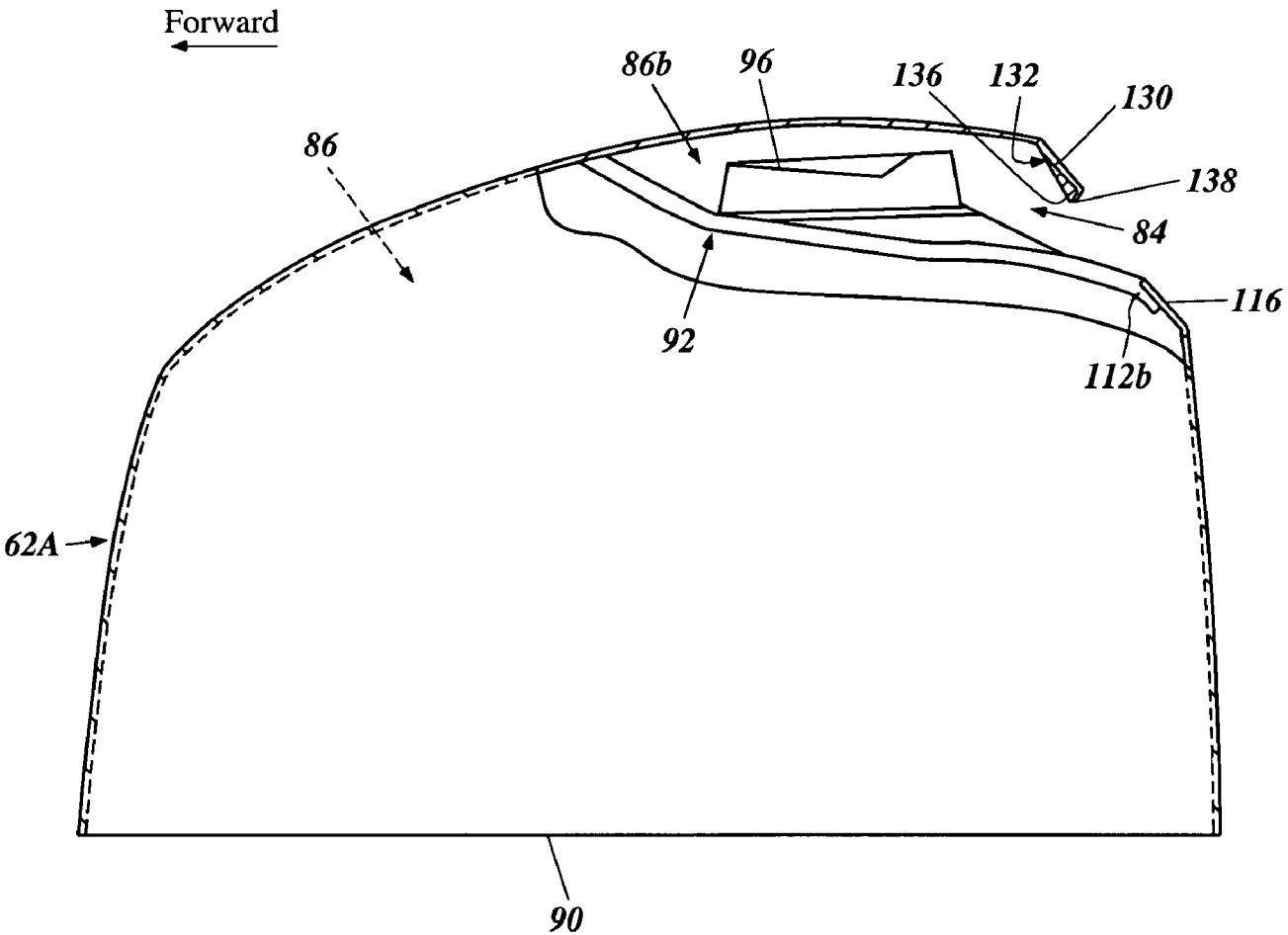
FIG. 5 is a side elevational view of another embodiment of a top cowling member, the top cowling member partly sectioned to show certain features.
Figure 6:
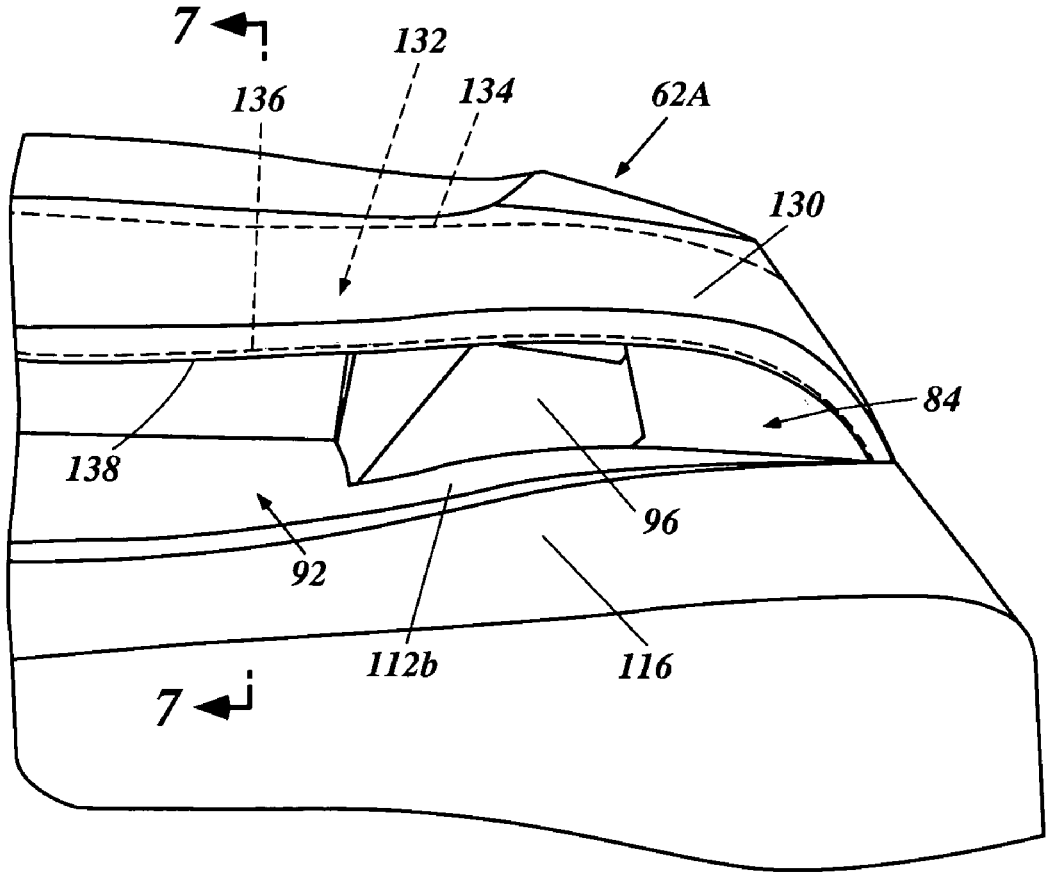
FIG. 6 is a partial rear elevational view of the cowling of FIG. 5.
Figure 7:
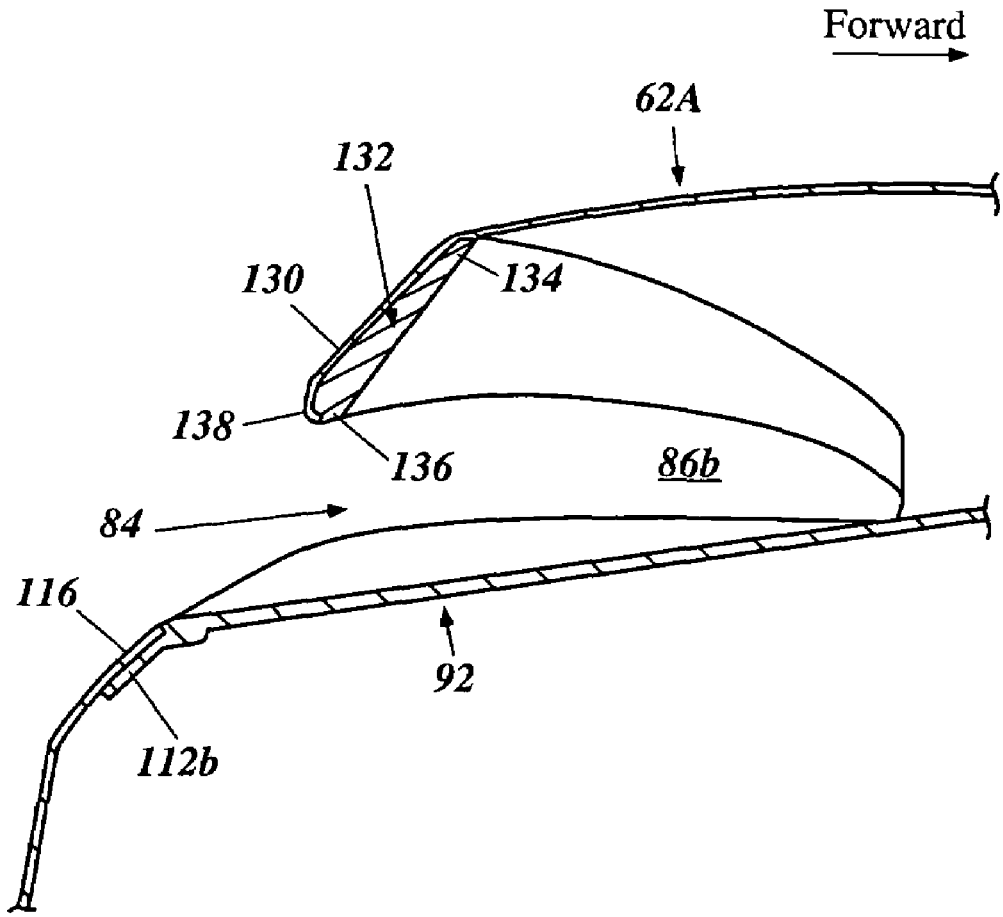
FIG. 7 is a partial cross sectional view of the cowling taken along the line 7-7 of FIG. 6.

In the embodiment illustrated in FIGS. 5-7, an inner pad 132 is affixed to an inner surface of the circumferential portion 130. The illustrated edge portion 130 slants downward rearwardly toward the bottom edge portion 116 which is positioned below the intake opening 84. Preferably, the inner pad 132 extends over almost the whole area of the inner surface of the upper edge portion 130. That-is, as best shown in FIG. 6, the inner pad 132 extends to side portions of the top cowling member 62A beyond respective side ends of the intake opening 84. Also, the inner pad 132 preferably has a top portion 134 and a bottom portion 136 as shown in FIGS. 6 and 7.

The inner pad 132 is preferably made of an elastic material such as, for example, a synthetic resin or a rubber material. The illustrated inner pad 132 is adhered to the inner surface of the upper edge portion 130 by an adhesive.

A bottom end 138 of the upper edge portion 130 preferably bends inward. The illustrated bottom end 138 gently curves inward. The bottom end 138 of the edge portion 130 holds the bottom portion of the inner pad 132. The bottom portion 136 of the inner pad 132 continuously extends inward from the bottom end 138 of the edge portion 130 that curves inward so as to form a smooth surface with the bottom end 138 of the circumferential portion 130.

Because the inner pad 132 is adhered to the inner surface of the edge portion 130 in this embodiment as noted above, the operator feels smooth when he or she grips the upper edge portion 130.

The inner pad 132 in this embodiment can also improve the rigidity of the upper edge portion 130. Particularly, the inner pad 132 can inhibit the edge portion 130 from vibrating in resonance with the engine. The resonance noise thus can be avoided.

Also, in this embodiment, because the edge portion 130 gently curves inward and the bottom portion 136 of the inner pad 132 continuously extends from the bottom end 138 of the edge portion 130 to form the smooth surface with the bottom end 138, the air can be smoothly introduced into the small cavity 86*b*. That is, air intake flow resistance can be reduced.

Figure 8:
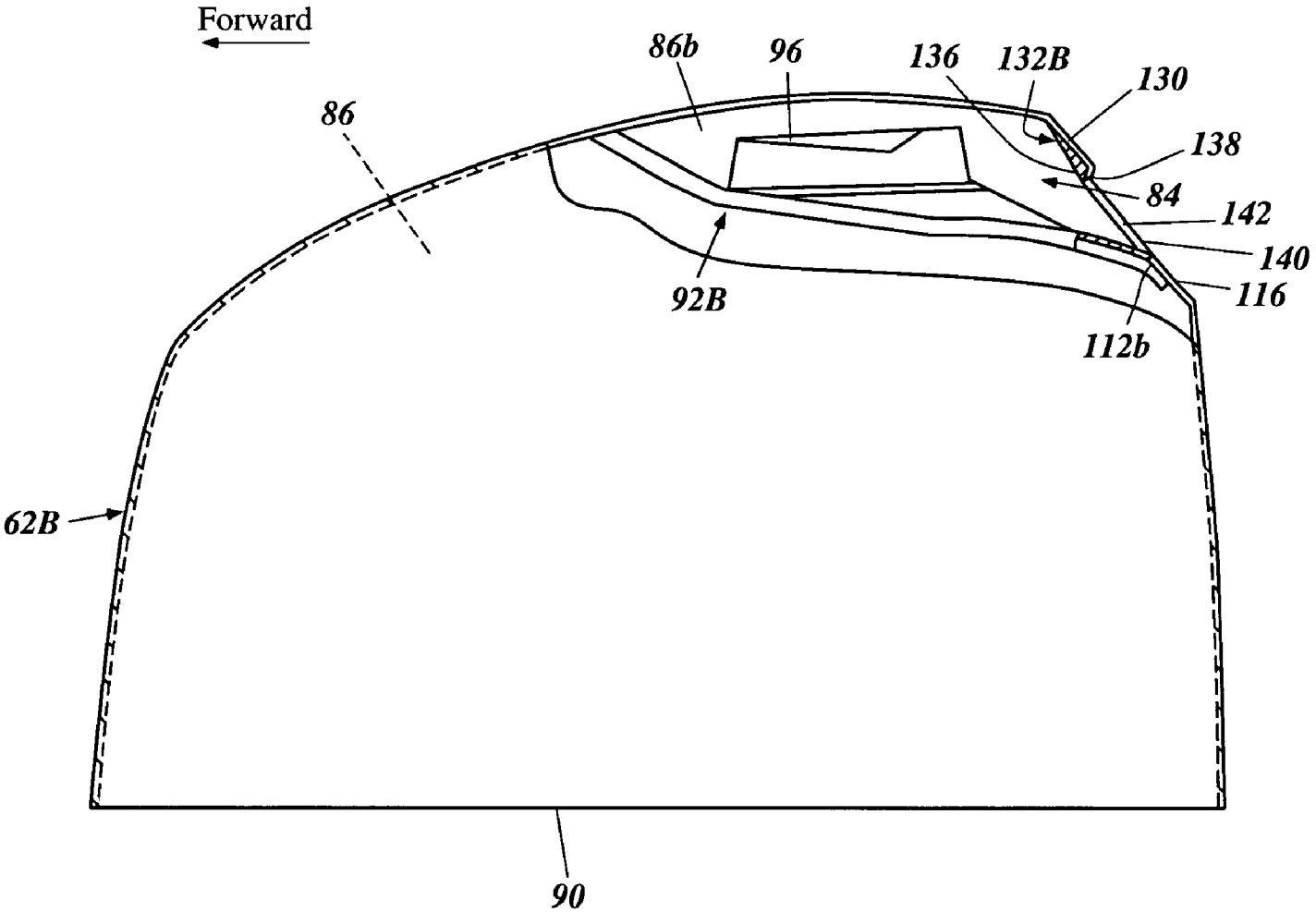
FIG. 8 is a side elevational view of a further embodiment of a top cowling member, the top cowling member partly sectioned to show certain features.
Figure 9:
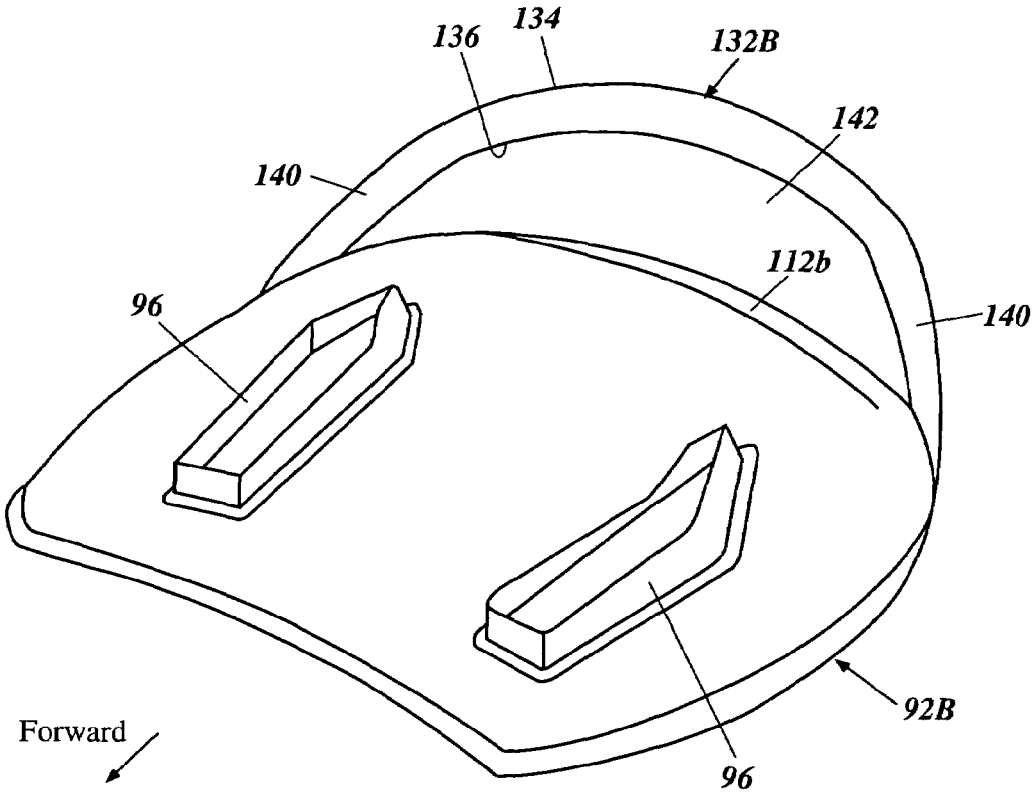
FIG. 9 is a perspective view of the partition member of FIG. 8.

With next reference to FIGS. 8 and 9, a further embodiment of a top cowling member 62B is described. The top cowling member 62B has a modified inner pad 132B. The same or similar members, components and the like described above will be assigned with the same reference numerals and will not be discussed repeatedly unless further discussions are warranted.

The partition member 92B in this arrangement is made of a synthetic resin, and the inner pad 132B is formed unitarily with the partition member 92B. Preferably, the inner pad 132B has a pair of leg portions 140 that extend upward from a rear end of the partition member 92B. The partition member 92B, the leg portions 140 and the inner pad 132B together define an opening 142. A size of the opening 142 is preferably consistent with a size of the intake opening 84. The leg portions 140 and the inner pad 132B slant upward and forward so as to extend along the inner surfaces of the edge portions 116, 130 of the top cowling member 62B around the intake opening 84.

The combined unit of the partition member 92B, the leg portions 140 and the inner pad 132B is adhered to the inner surface of the top cowling member 62B by an adhesive.

Because the inner pad 132B is united with the partition member 92B in this arrangement, both of the components 132B, 92B can be simultaneously adhered to the top cowling member 62B. Thus, part assembly is particularly quick and easy.

Although this invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an engine, a cowling body defining an internal cavity in which the engine is enclosed, and a partition member dividing the internal cavity into a first cavity and a second cavity, a first opening formed through the cowling body and opening into the first cavity for introduction of outside air into the first cavity, an inner pad affixed to an inner surface of an upper edge portion of the cowling body above the first opening, the second cavity enclosing the engine therein, the partition member having a second opening through which air in the first cavity is introduced into the second cavity, the cowling body and the partition member being made of a nonferrous metal, and the partition member being adhered to an inner surface of the cowling body with an adhesive.

2. The outboard motor according to claim 1, wherein the inner pad is adhered to the inner surface of the cowling body with an adhesive.

3. The outboard motor according to claim 2, wherein a bottom end of the upper edge portion bends inward.

4. The outboard motor according to claim 3, wherein the bottom end of the circumferential portion holds a bottom portion of the inner pad.

5. The outboard motor according to claim 4, wherein a bottom portion of the inner pad continuously extends inward from the bottom end of the upper edge portion so as to form a smooth surface with the bottom end of the upper edge portion.

6. The outboard motor according to claim 1, wherein the inner pad is made of an elastic material.

7. The outboard motor according to claim 1, wherein a front end of the partition member is adhered to a top inner surface of the cowling body.

8. The outboard motor according to claim 7, wherein a rear end of the partition member is adhered to an inner surface of the cowling body below the first opening.

9. The outboard motor according to claim 1, wherein the partition member has an elongate air duct defining the second opening, and the air duct is formed separately from the remainder of the partition member.

10. The outboard motor according to claim 9, wherein the partition member has at least one aperture for discharging water from the first cavity.

11. The outboard motor according to claim 9, wherein the air duct is adhered to the partition member by an adhesive.

12. The outboard motor according to claim 1, wherein the partition member has a plurality of elongate ribs.

13. The outboard motor according to claim 12, wherein the partition ribs are arranged so as to extend in a fore-to-aft direction.

14. A method of making an outboard motor, comprising providing an engine, providing a cowling comprising a top cowling body having an inner surface and an intake air opening formed through the cowling body, providing a partition member having an air duct opening formed therethrough, the partition member having a circumferential flange that is generally complementary to a portion of the inner surface of the top cowling body, applying an adhesive to the circumferential flange, adhering the circumferential flange to the inner surface of the top cowling body so that the flange fits substantially flush with the top cowling body and an intake space is defined between the partition member and the inner surface of the top cowling body, the partition member positioned so that the intake air opening opens into the intake space, and adhering an inner pad member to an inner surface of the top cowling member at or adjacent an upper edge portion of the intake air opening.

15. A method as in claim 14 additionally comprising positioning the top cowling over the engine so that the engine is generally enclosed by the top cowling.

16. A method as in claim 14 additionally comprising providing an elongate air duct, and adhering the air duct to the partition member so as to align with the air duct opening.

17. A method as in claim 16, wherein providing the elongate air duct comprises forming at least two air duct members, and adhering the air duct members to one another to form the elongate air duct.

18. A method as in claim 14 additionally comprising forming the top cowling body and the partition member out of substantially the same type of material.

19. The outboard motor according to claim 1, wherein the partition member has a circumferential face that is shaped to complement and fit substantially flush with an inner surface of the cowling body about the circumference of the partition member, and the partition member circumferential face is adhered to the inner surface of the cowling body.

20. The outboard motor according to claim 19, wherein the circumferential face comprises a front face portion, a rear face portion, and opposing side face portions, and wherein the front, rear and side face portions are contiguous with one another.

21. The outboard motor according to claim 19, wherein the circumferential face of the partition member is angled generally downward so as to be complementary to the inner surface of the cowling body.

22. The outboard motor according to claim 21, wherein the circumferential face of the partition member fits generally flush against the inner surface of the cowling body so as to create a seal about the circumferential portion between the partition member and the cowling body.

23. The outboard motor according to claim 22, wherein the partition member and the cowling body are made of substantially the same material.

24. The outboard motor according to claim 22, wherein no mechanical fasteners are used to connect the partition member to the cowling body.

* * * * *